US010654270B2

(12) United States Patent
Chen et al.

(10) Patent No.: US 10,654,270 B2
(45) Date of Patent: May 19, 2020

(54) PRINTHEAD COMPRISING A THIN FILM PASSIVATION LAYER

(71) Applicant: HEWLETT-PACKARD DEVELOPMENT COMPANY, L.P., Fort Collins, CO (US)

(72) Inventors: Zhizhang Chen, Corvallis, OR (US); Mohammed S Shaarawi, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/094,953

(22) PCT Filed: Jul. 12, 2016

(86) PCT No.: PCT/US2016/041944
§ 371 (c)(1),
(2) Date: Oct. 19, 2018

(87) PCT Pub. No.: WO2018/013093
PCT Pub. Date: Jan. 18, 2018

(65) Prior Publication Data

US 2019/0152226 A1 May 23, 2019

(51) Int. Cl.
*B41J 2/14* (2006.01)
*B41J 2/16* (2006.01)

(52) U.S. Cl.
CPC ..... *B41J 2/14129* (2013.01); *B41J 2/162* (2013.01); *B41J 2/1603* (2013.01); *B41J 2/1631* (2013.01); *B41J 2/1642* (2013.01); *B41J 2/1645* (2013.01); *B41J 2/1646* (2013.01)

(58) Field of Classification Search
CPC ..... B41J 2/14129; B41J 2/1603; B41J 2/162; B41J 2/1631; B41J 2/1642; B41J 2/1645; B41J 2/1646
See application file for complete search history.

(56) References Cited

U.S. PATENT DOCUMENTS

| | | | | |
|---|---|---|---|---|
| 6,126,277 | A | 10/2000 | Feinn et al. | |
| 6,286,939 | B1 * | 9/2001 | Hindman et al. | 347/63 |
| 6,929,349 | B2 | 8/2005 | Bell | |
| 7,375,040 | B2 | 5/2008 | Lin et al. | |
| 7,939,367 | B1 | 5/2011 | Nasser-Faili et al. | |
| 8,727,499 | B2 * | 5/2014 | Pugliese, Jr. et al. | 347/61 |
| 9,259,922 | B2 | 2/2016 | Cagle et al. | |
| 2003/0027413 | A1 | 2/2003 | Tsui | |

(Continued)

FOREIGN PATENT DOCUMENTS

| | | |
|---|---|---|
| CN | 101035678 | 9/2007 |
| CN | 102689517 | 9/2012 |

(Continued)

OTHER PUBLICATIONS

Wei, Y., et al. Atomic layer deposition for fabrication of HfO2/Al2O3 thin films with high laser-induced damage thresholds, Jan. 5, 2015.

*Primary Examiner* — Juanita D Jackson
(74) *Attorney, Agent, or Firm* — Austin Rapp

(57) ABSTRACT

According to an example, a printhead including a thin film passivation layer, an adhesion layer, and a fluidics layer; wherein the thin film passivation layer is an atomic layer deposition thin film layer is disclosed.

18 Claims, 3 Drawing Sheets

(56) References Cited

U.S. PATENT DOCUMENTS

| | | | |
|---|---|---|---|
| 2005/0001864 | A1 | 1/2005 | Sohn et al. |
| 2005/0078151 | A1 | 4/2005 | Bell et al. |
| 2006/0110938 | A1 | 5/2006 | Lin et al. |
| 2007/0003733 | A1 | 1/2007 | Muller |
| 2008/0313901 | A1 | 12/2008 | Bich et al. |
| 2014/0210912 | A1 | 7/2014 | Cagle et al. |

FOREIGN PATENT DOCUMENTS

| | | | |
|---|---|---|---|
| WO | WO-2005068288 | | 7/2005 |
| WO | WO-2015147804 | A1 | 10/2015 |

* cited by examiner

PRINTHEAD COMPRISING A THIN FILM PASSIVATION LAYER

BACKGROUND

Devices are sometimes formed using a thin film stack of materials. For example, thermal inkjet devices, piezoelectric devices, ferroelectric devices, pyroelectric devices, electrocaloric devices, and various other types of devices may include such thin film stacks in a specific configuration.

DETAILED DESCRIPTION

For simplicity and illustrative purposes, the present disclosure is described by referring mainly to examples thereof. In the following description, numerous specific details are set forth in order to provide a thorough understanding of the present disclosure. It will be readily apparent however, that the present disclosure may be practiced without limitation to these specific details. In other instances, some methods and structures have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

An example of the present disclosure includes a printhead including a thin film passivation layer, an adhesion layer, and a fluidics layer. The thin film passivation layer may be an atomic layer deposition thin film layer. A printhead including the disclosed layers can exhibit improved energy efficiency as compared to a printhead that does not include the disclosed layers. Additionally, a printhead including the disclosed layers can exhibit reduced delamination between the thin film passivation layer and the fluidics layer. Further, the printhead having a thin film passivation layer, an adhesion layer, and a fluidics layer can be formed having a total physical thickness of the layers is less than printheads formed without a thin film passivation layer formed by atomic layer deposition.

Figure 1:
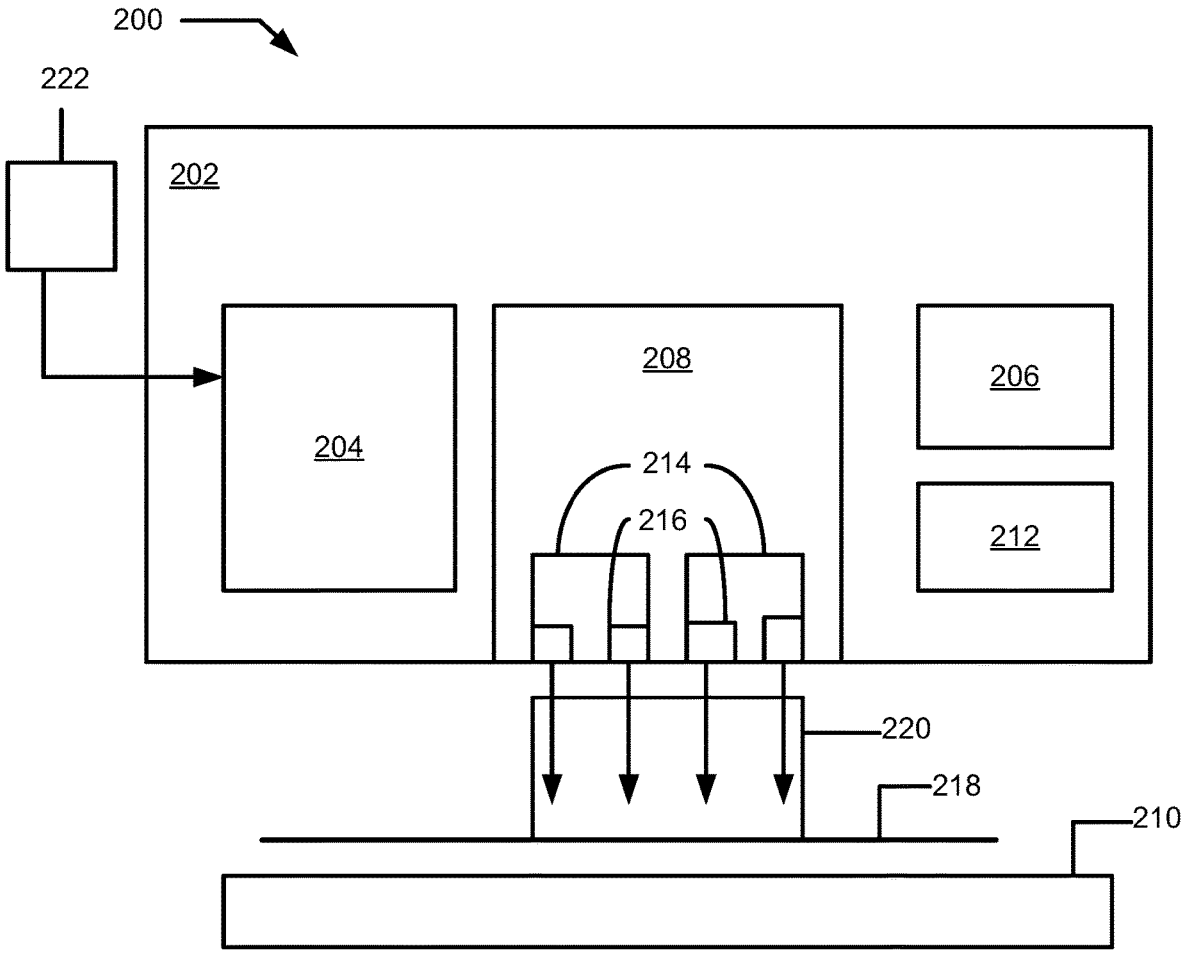
FIG. 1 shows an example of an ink jet printing system suitable for implementing an inkjet printhead, according to an example of the present disclosure.

FIG. 1 shows an example of a an inkjet printing system 200 that includes a print engine 202, such as a scanning or a non-scanning type, having a controller 204, a mounting assembly 206, one or more replaceable fluid supply devices 208, a media transport assembly 210, and at least one power supply 212 that provides power to the various electrical components of inkjet printing system 200. The inkjet printing system 200 further includes one or more inkjet printheads 214 that eject drops of ink or other fluid through a plurality of nozzles 216 (also referred to as orifices or bores) toward print media 218 so as to print onto the media 218. In some examples a printhead 214 may be an integral part of a supply device 208, while in other examples a printhead 214 may be mounted on a print bar (not shown) of mounting assembly 206 and coupled to a supply device 208 (e.g., via a tube). Print media 218 can be any type of suitable sheet or roll material, such as paper, card stock, transparencies, Mylar, polyester, plywood, foam board, fabric, canvas, and the like.

In an aspect, printhead 214 may be a thermal-inkjet (TIJ) printhead 214. In TIJ printheads 214, electric current is passed through a resistor element to generate heat in an ink-filled chamber. Referring briefly now to both FIGS. 1 and 2, the heat vaporizes a small quantity of ink or other fluid, creating a rapidly expanding vapor bubble that forces a fluid drop out of a nozzle 216. As the resistor element cools the vapor bubble collapses, drawing more fluid from a reservoir into the chamber in preparation for ejecting another drop through the nozzle 216. Nozzles 216 are typically arranged in one or more columns or arrays along printhead 214 such that properly sequenced ejection of ink from nozzles 216 causes characters, symbols, and/or other graphics or images to be printed on print media 218 as the printhead 214 and print media 218 are moved relative to each other.

Mounting assembly 206 positions printhead 214 relative to media transport assembly 210, and media transport assembly 210 positions print media 218 relative to printhead 214. Thus, a print zone 220 is defined adjacent to nozzles 216 in an area between printhead 214 and print media 218. Electronic controller 204 typically includes components of a standard computing system such as a processor, memory, firmware, and other printer electronics for communicating with and controlling supply device 208, printhead 214, mounting assembly 206, and media transport assembly 210. Electronic controller 204 receives data 222 from a host system, such as a computer, and temporarily stores the data 222 in a memory. Using data 222, electronic controller 204 controls printhead 214 to eject ink drops from nozzles 216 in a defined pattern that forms characters, symbols, and/or other graphics or images on print medium 218.

Figure 2:
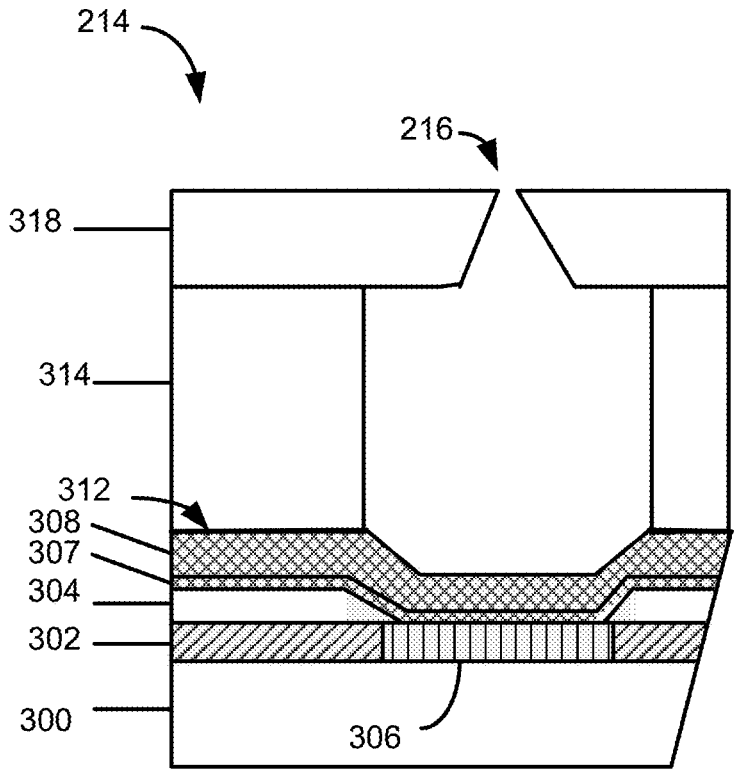
FIG. 2 shows a partial cross-sectional view of an example thermal inkjet printhead, according to an example of the present disclosure.

FIG. 2 shows a partial cross-sectional view of an example TIJ printhead 214 that employs a thin film passivation layer over a thermal resistor to protect the resistor surface from damage during a fluid slot formation process, according to an example of the disclosure. The thin film passivation layer may also electrically insulate the resistor from the layers above the resistor. The TIJ printhead 214 can include a substrate 300 typically made of silicon (Si), or another appropriate material such as glass, a semiconductive material, various composites, and so on.

A resistor layer 302 may be formed on the substrate 300. Thermal/firing resistors are formed by depositing (e.g., by sputter deposition) resistor layer 302 over the substrate 300. The resistor layer 302 is typically on the order of about 0.02 to 0.75 microns thick, and can be formed of various suitable resistive materials including, for example, tantalum aluminum, tungsten silicon nitride, nickel chromium, carbide, platinum and titanium nitride. Resistor layers 302 having other thicknesses are also within the scope of this disclosure.

A conductive layer 304 may be deposited (e.g., by sputter deposition techniques) on resistor layer 302 and patterned (e.g., by photolithography) and etched to form conductor traces and an individually formed resistor 306 from the underlying resistor layer 302. The conductor layer 304 can be made of various materials including, for example, aluminum, aluminum/copper alloy, copper, gold, and so on. One or more additional overcoat layers (not shown) can be formed over the resistor to provide additional structural stability and electrical insulation from fluid in the firing chamber. Overcoat layers may generally be considered to be part and parcel of resistor, and, as such, they may provide a final layer to resistor. Overcoat layers typically include an insulating passivation layer formed over the resistor and the conductor traces to prevent electrical charging of the fluid or corrosion of the device in the event that an electrically conductive fluid is used. Overcoat layers also include a cavitation barrier layer (not shown) over the passivation layer that helps dissipate the force of the collapsing drive bubble left in the wake of each ejected fluid drop. The cavitation layer has a thickness on the order of about 0.1 to 0.75 microns but it may also have a greater or lesser thickness, and it is often, but not necessarily, formed of tantalum deposited by a sputter deposition technique. The cavitation layer may generally be considered to be the final layer of resistor and therefore makes up the surface of the resistor. Certain fluid slot fabrication processes can etch and damage the surface of these resistors.

FIG. 2 illustrates a printhead 213 having a thin film passivation layer 308. The thin film passivation layer 308 can be formed of various dielectric materials including, for example, hafnium oxide ($HfO_2$), zirconium dioxide ($ZrO_2$), aluminum oxide ($Al_2O_3$), titanium oxide ($TiO_2$), hafnium silicon nitride ($HfSi_3N_4$), silicon oxide ($SiO_2$), silicon nitride ($Si_3N_4$), and so on. In an aspect, the thin film passivation layer 308 can include a hafnium oxide ($HfO_2$) layer formed by an atomic layer deposition process. The thin film passivation layer 308 can comprise a plurality of single molecule layers formed one-at-a-time in an atomic layer deposition process.

The thin film passivation layer 308 can have a thickness ranging from about 100 Å to about 1100 Å, for example from about 100 Å to about 500 Å. In an aspect, atomic layer deposition allows the formation of a thinner thin film passivation layer 308 as compared to other deposition techniques.

The thin film passivation layer 308 may also include a silicon nitride layer 307. The silicon nitride layer 307 may be deposited on the resistor layer 302 using any suitable technique, including, but not limited to physical vapor deposition (PVD), pulsed laser deposition (PLD), evaporative deposition, low pressure chemical vapor deposition (LPCVD), atmosphere pressure chemical vapor deposition (APCVD), chemical vapor deposition (CVD), plasma enhanced physical vapor deposition (PEPVD), plasma enhanced chemical vapor deposition (PECVD), atomic layer deposition (ALD), plasma enhanced atomic layer deposition (PEALD), sputter deposition, evaporation, thermal oxide deposition or growth, spin-coating of appropriate precursor mixtures and baking (i.e. spin on glass), or the like.

The silicon nitride layer 307 can have any suitable thickness to provide electrical isolation. In an aspect, the thickness of the silicon nitride layer 307 may depend upon the voltage of the printhead 214. For example, if a high voltage is needed, then the silicon nitride layer 307 is thicker. In another aspect, if a lower voltage is needed, then the silicon nitride layer 307 is thinner. In an aspect, the silicon nitride layer 307 can have a thickness ranging from about 100 Å to about 800 Å, for example from about 200 Å to about 700 Å, and as a further example 600 Å.

FIG. 2 also illustrates a printhead 214 having an adhesion layer 312. The adhesion layer 312 may include any material that may adhere the thin film passivation layer 308 to the fluidics layer 314. In an aspect, the adhesion layer 312 may include silicon carbide (SiC). The adhesion layer 312 may be deposited on the thin film passivation layer 308 using any suitable technique, including, but not limited to physical vapor deposition (PVD), pulsed laser deposition (PLD), evaporative deposition, low pressure chemical vapor deposition (LPCVD), atmosphere pressure chemical vapor deposition (APCVD), chemical vapor deposition (CVD), plasma enhanced physical vapor deposition (PEPVD), plasma enhanced chemical vapor deposition (PECVD), sputter deposition, evaporation, thermal oxide deposition or growth, spin-coating of appropriate precursor mixtures and baking (i.e. spin on glass), or the like.

In an aspect, the adhesion layer 312 may be deposited in any suitable thickness so long as the thin film passivation layer 308 adheres to the fluidics layer 314. The adhesion layer 312 may have a thickness ranging from about 50 Å to about 350 Å, for example from about 60 Å to about 300 Å, and as a further example from about 100 Å to about 200 Å. If the adhesion layer 312 is less than about 50 Å, then the adhesion layer 312 may be too thin to adhere the thin film passivation layer 308 to the fluidics layer 314. If the adhesion layer 312 is greater than about 350 Å, then the adhesion layer 312 may be too thick, possibly having a negative effect on energy efficiency of a printhead.

The fluidics layer 314 may typically be a patterned SU8 layer. SU8 is a photoimageable negative acting epoxy. The total thickness of the fluidics layer 314 may range from about 4 μm to about 100 μm.

A nozzle layer 318 includes nozzles (orifices) 216 formed over respective chambers, such that each chamber, associated nozzle 216, and associated resistor 306 are aligned. In some implementations the fluidics layer 314 and nozzle layer 318 are integrated as a single structure formed of SU8 or another appropriate material.

In an aspect, the printhead 214 can include a fluidics layer 314 of an epoxy-based resin; a thin film passivation layer 308 of hafnium oxide at a thickness of about 200 Å and a silicon nitride layer 307 at a thickness of about 600 Å, and an adhesion layer 308 of silicon carbide at a thickness of about 200 Å, so that the total thickness of the thin film passivation layer, silicon nitride layer, and adhesion layer has a thickness of about 1000 Å.

Figure 3:
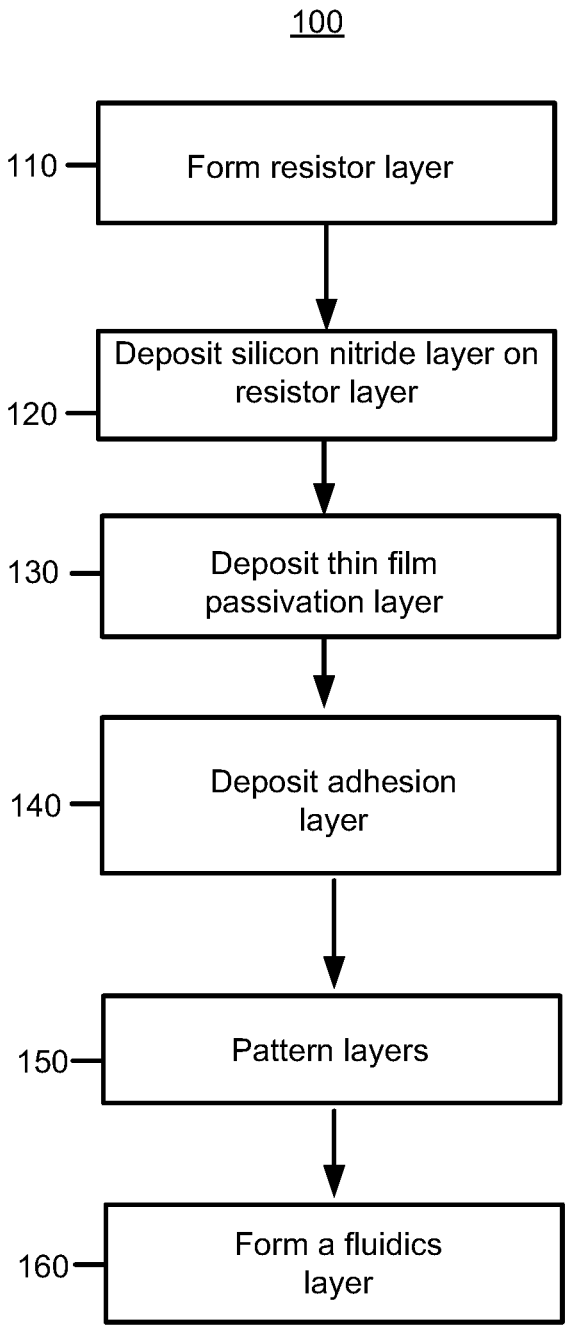
FIG. 3 is a process flow diagram of a method, in accordance with an example of the present disclosure.

Processing for the method 100 may begin or continue with forming a CMOS circuit on a substrate 300, such as a silicon substrate. Turning now to FIG. 3, the method 100 can continue with forming a resistor layer 302, such as from tungsten silicon nitride (WSiN), at block 110.

The method 100 continues with depositing a silicon nitride layer 307 on the resistor layer. The silicon nitride layer 307 can be deposited using conventional techniques, such as physical vapor deposition (PVD), pulsed laser deposition (PLD), evaporative deposition, low pressure chemical vapor deposition (LPCVD), atmosphere pressure chemical vapor deposition (APCVD), chemical vapor deposition (CVD), plasma enhanced physical vapor deposition (PEPVD), plasma enhanced chemical vapor deposition (PECVD), atomic layer deposition (ALD), plasma enhanced atomic layer deposition (PEALD), sputter deposition, evaporation, thermal oxide deposition or growth, spin-coating of appropriate precursor mixtures and baking (i.e. spin on glass), or the like. The silicon nitride layer can be deposited at a thickness ranging from about 100 Å to about 800 Å, for example from about 200 Å to about 700 Å, and as a further example 600 Å.

The method 100 continues at block 130 with depositing a thin film passivation layer 308 using atomic layer deposition on the silicon nitride layer 307. In an aspect, the thin film passivation layer 308 can be formed of various dielectric materials including, for example, hafnium oxide ($HfO_2$), zirconium dioxide ($ZrO_2$), aluminum oxide ($Al_2O_3$), titanium oxide ($TiO_2$), hafnium silicon nitride ($HfSi_3N_4$), silicon oxide ($SiO_2$), silicon nitride ($Si_3N_4$), and so on. The thin film passivation layer 308 may be deposited at a thickness ranging from about 100 Å to about 1100 Å, for example from about 100 Å to about 500 Å. In an aspect, the thin film passivation layer 308 may increase the energy efficiency of a printhead 214 comprising the thin film passivation layer 308.

The method 100 continues at block 140 with depositing an adhesion layer 312 on the thin film passivation layer 308. The adhesion layer 312 may comprise a silicon carbide layer. In an aspect, the adhesion layer 312 may be deposited using conventional deposition techniques, such as plasma enhanced chemical vapor deposition. In an aspect, the adhesion layer 312 may reduce delamination between the thin film passivation layer 308 and the fluidics layer 314. In an aspect, the adhesion layer 312 may be deposited at a thickness ranging from about 50 Å to about 350 Å, for example from about 60 Å to about 300 Å, and as a further example from about 100 Å to about 200 Å.

The method 100 continues at block 150 with patterning the layers, such as the thin film passivation layers.

The method 100 continues at block 160 with forming a fluidics layer 314, such as an SU8. SU8 is a photoimageable negative acting epoxy-based resin. The SU8 can be formed as a dry film laminated by heat and pressure or as a wet film applied by spin coating.

In an aspect, an inkjet printing system 200 can include a print engine 202, a fluid supply device 208 including a printhead 214. The printhead 214 can include a thin film passivation layer 308, wherein the thin film passivation layer 308 is an atomic layer deposition thin film layer. The printhead 214 can also include an adhesion layer 312 and a fluidics layer 314.

The thin film passivation layer 308 can include at least one material selected from the group consisting of hafnium oxide ($HfO_2$), zirconium dioxide ($ZrO_2$), aluminum oxide ($Al_2O_3$), titanium oxide ($TiO_2$), hafnium silicon nitride ($HfSi_3N_4$), silicon oxide ($SiO_2$), and silicon nitride ($Si_3N_4$), for example at a thickness ranging from about 100 Å to about 1100 Å.

The adhesion layer 312 of the inkjet printing system 100 can be silicon carbide (SiC) at a thickness ranging from about 50 Å to about 350 Å.

The printhead 214 of the inkjet printing system 100 can further include a silicon nitride layer 307.

Although described specifically throughout the entirety of the instant disclosure, representative examples of the present disclosure have utility over a wide range of applications, and the above discussion is not intended and should not be construed to be limiting, but is offered as an illustrative discussion of aspects of the disclosure. What has been described and illustrated herein is an example of the disclosure along with some of its variations. The terms, descriptions and figures used herein are set forth by way of illustration only and are not meant as limitations. Many variations are possible within the spirit and scope of the disclosure, which is intended to be defined by the following claims—and their equivalents—in which all terms are meant in their broadest reasonable sense unless otherwise indicated.

What is claimed is:

1. A printhead comprising:

a silicon nitride layer;

a thin film passivation layer deposited onto the silicon nitride layer, wherein the thin film passivation layer is an atomic layer deposition thin film layer;

an adhesion layer deposited onto the thin film passivation layer deposited onto the silicon nitride layer; and a fluidics layer formed on the adhesion layer.

2. The printhead of claim 1, wherein the thin film passivation layer comprises at least one material selected from the group consisting of hafnium oxide (HfO2), zirconium dioxide (ZrO2), aluminum oxide (AI2O3), titanium oxide (TiO2), hafnium silicon nitride (HfSi3N4), silicon oxide (SiO2), and silicon nitride (Si3N4).

3. The printhead of claim 1, wherein the thin film passivation layer has a thickness ranging from about 100 Å to about 1100 Å.

4. The printhead of claim 3, wherein the thin film passivation layer has a thickness ranging from about 100 Å to about 500 Å.

5. The printhead of claim 1, wherein the adhesion layer comprises silicon carbide (SiC).

6. The printhead of claim 1, wherein the adhesion layer has a thickness ranging from about 50 Å to about 350 Å.

7. The printhead of claim 6, wherein the adhesion layer has a thickness ranging from about 100 Å to about 200 Å.

8. The printhead of claim 1, wherein the fluidics layer comprises an epoxy-based negative photoresist.

9. A method of forming a printhead comprising:

depositing a silicon nitride layer onto a resistor layer;

depositing a thin film passivation layer onto the silicon nitride layer using atomic layer deposition;

depositing an adhesion layer onto the thin film passivation layer deposited onto the silicon nitride layer; and forming a fluidics layer on the adhesion layer.

10. The method of claim 9, wherein the adhesion layer is deposited using plasma enhanced chemical vapor deposition.

11. The method of claim 9, wherein the silicon nitride layer is deposited using a deposition process chosen from plasma enhanced chemical vapor deposition, atomic layer deposition, and plasma enhanced atomic layer deposition.

12. The method of claim 9, wherein the adhesion layer reduces delamination between the thin film passivation layer and the fluidics layer.

13. The method of claim 9, wherein the thin film passivation layer increases the energy efficiency of a printhead comprising the thin film passivation layer.

14. The method of claim 9, wherein the deposited adhesion layer, deposited thin film passivation layer, and deposited silicon nitride have a total thickness of about 1000 Å.

15. An inkjet printing system, comprising:

a print engine comprising a fluid supply device comprising a printhead, wherein the printhead comprises a silicon nitride layer;

a thin film passivation layer deposited onto the silicon nitride layer, wherein the thin film passivation layer is an atomic layer deposition thin film layer;

an adhesion layer deposited onto the thin film passivation layer deposited onto the silicon nitride layer; and a fluidics layer formed on the adhesion layer.

16. The inkjet printing system of claim 15, wherein the thin film passivation layer comprises at least one material selected from the group consisting of hafnium oxide (HfO2), zirconium dioxide (ZrO2), aluminum oxide (AI2O3), titanium oxide (TiO2), hafnium silicon nitride (HfSi3N4), silicon oxide (SiO2), and silicon nitride (Si3N4).

17. The inkjet printing system of claim 15, wherein the thin film passivation layer has a thickness ranging from about 100 Å to about 1100 Å.

18. The inkjet printing system of claim 15, wherein the adhesion layer comprises silicon carbide (SiC) at a thickness ranging from about 50 Å to about 350 Å.

* * * * *